US006035590A

United States Patent [19]

Lindsay

[11] Patent Number: 6,035,590

[45] **Date of Patent: *Mar. 14, 2000**

[54] PERIPHERAL BEAM SYSTEM FOR MANUFACTURED HOME

[76] Inventor: Frederick H. Lindsay, 9393 - 120th La. N., Seminole, Fla. 34642

[ * ] Notice: This patent issued on a continued prosecution application filed under 37 CFR 1.53(d), and is subject to the twenty year patent term provisions of 35 U.S.C. 154(a)(2).

[21] Appl. No.: 08/840,674

[22] Filed: Apr. 29, 1997

[51] Int. Cl.[7] ..... B60P 3/32; B62D 21/02; B62D 63/06

[52] U.S. Cl. ..... 52/143; 52/299; 52/650.3; 52/653.1; 280/789; 296/182; 296/204

[58] Field of Search ..... 52/143, 650.1, 52/650.3, 653.1, 690, 693, 299, 79.12; 280/785, 789, 795, 799; 296/181, 182, 204

[56] References Cited

U.S. PATENT DOCUMENTS

| | | | |
|---|---|---|---|
| 3,254,914 | 6/1966 | Steck | 296/181 |
| 3,492,767 | 2/1970 | Pincus | 52/143 |
| 3,664,082 | 5/1972 | Zintel | 52/143 X |
| 3,697,098 | 10/1972 | Fisher | 52/143 X |
| 3,716,267 | 2/1973 | Lindsay | 52/143 X |
| 3,751,870 | 8/1973 | Vesel . | |
| 4,015,375 | 4/1977 | Lindsay . | |
| 4,019,299 | 4/1977 | Lindsay . | |
| 4,065,892 | 1/1978 | Lawrence | 52/143 |
| 4,067,158 | 1/1978 | Lawrence | 52/143 |
| 4,106,258 | 8/1978 | Lindsay . | |
| 4,863,189 | 9/1989 | Lindsay . | |
| 4,930,809 | 6/1990 | Lindsay . | |
| 5,028,072 | 7/1991 | Lindsay | 52/143 X |
| 5,113,625 | 5/1992 | Davis | 52/143 |
| 5,201,546 | 4/1993 | Lindsay . | |
| 5,226,583 | 7/1993 | Imashimizu et al. . | |
| 5,488,809 | 2/1996 | Lindsay | 52/143 X |
| 5,553,989 | 9/1996 | Ullman | 280/789 X |
| 5,579,622 | 12/1996 | De Von et al. . | |

FOREIGN PATENT DOCUMENTS

| | | | |
|---|---|---|---|
| 1562963 | 3/1969 | France | 52/143 |
| 822893 | 10/1951 | Germany | 52/143 |

*Primary Examiner*—Laura A. Callo

[57] ABSTRACT

A peripheral beam system for a manufactured home comprising a multiplicity of transverse beams secured perpendicular to plural longitudinally extending beams. Plural peripheral beams are secured to the multiplicity of transverse beams to extend parallel to the plural longitudinally extending beams. The peripheral beams extend downwardly from the manufactured home for resting on a foundation to support the manufactured home relative to a foundation. The downwardly extending peripheral beams enabling the manufactured home to be mounted onto a foundation at a permanent home site through the use of simple lifting jacks and without the use of lifting cranes.

8 Claims, 16 Drawing Sheets

PERIPHERAL BEAM SYSTEM FOR MANUFACTURED HOME

BACKGROUND OF THE INVENTION

1. Field Of The Invention

This invention relates to manufactured homes and more particularly to an improved peripheral beam system for a manufactured home.

2. Background Of The Invention

In recent years, the manufactured home industry has substantially increased the quality of materials and construction of manufactured homes. This increase in quality and construction has been the result of superior materials, superior construction techniques, and new innovations which have resulted in a substantial increase in performance with a reduction in cost.

In general, a manufactured home is erected in an automated manufacturing factory using modern patterns, assembly line, and modern assembly equipment. The use of these automation techniques substantially reduces the cost and the time of construction of the manufactured home. After the manufactured home is completed, the manufactured home is stored on supports to await transportation to a permanent site for the manufactured home.

The manufactured home is loaded on a transportation carrier for transportation to the permanent site for the manufactured home. The manufactured home is positioned onto the transportation carrier by crane or other lifting means. The transportation carrier comprises a steel frame assembly supported by plural axles and transport wheels. The transportation carrier includes a hitch for attaching the transportation carrier to a towing vehicle such as a truck for transporting the manufactured home to the permanent site.

After the manufactured home is towed to the permanent site, the manufactured home is removed from the transportation carrier by a crane or other lifting means and the manufactured home is positioned on a foundation at the permanent home site. After removal of the manufactured home, the carrier transport is towed back to the manufacturing factory by a towing vehicle such as a truck for use in delivering another manufactured home. Unfortunately, the carrier transport is returned to the manufacturing factory without a load thereby substantially increasing the overall cost of delivery of the manufactured home. It is estimated that the cost of returning the carrier transport to the manufacturing factory is approximately one dollar per mile. Furthermore, the task of moving the manufactured home from the carrier transport to the foundation at the permanent home site requires the use of a crane of other lifting means. Accordingly, the transportation and installation of manufactured homes requiring the use of a carrier transport substantially adds to the overall cost of the manufactured home.

Among the most significant construction innovations developed in the manufactured home industry is the use of a dual purpose flooring system for a manufactured home. The dual purpose flooring system for a manufactured home comprises plural longitudinally extending beams and a multiplicity of transverse cross beams. The plural longitudinally extending beams are preferably steel I-beams with the multiplicity of transverse cross beams comprising wooden trusses.

The dual purpose flooring system provides a first function for the manufactured home by providing a removable transport wheel assembly and a removable hitch assembly for transporting the manufactured home to the permanent home site. Preferably, a removable transport wheel assembly and a removable hitch assembly are secured to the plural longitudinally extending beams for transporting the manufactured home and eliminating the need for an independent transportation carrier. When the manufactured home reaches the permanent home site, the removable transport wheel assembly and a removable hitch assembly are removed from the manufactured home and are shipped to the manufacturing factory. Only the removable transport wheel assembly and a removable hitch assembly which comprise the most expensive portions of a transport carrier need to be returned to the manufacturing factory. In addition, the removable transport wheel assembly and a removable hitch may be returned to the manufacturing factory by a conventional freight carrier thus eliminating the need for using the towing vehicle as was the problem in the prior art manufactured home carrier transports.

The dual purpose flooring system provides a second function for the manufactured home by reducing the overall height of the manufactured home when the manufactured home is being transported to the permanent home site. Since the removable transport wheel assembly and the removable hitch assembly are directly secured to the plural longitudinally extending beams of the manufactured home, the dual purpose flooring system reduces the overall height of the manufactured home during transportation by the thickness of the frame of the carrier transport of the prior art.

The dual purpose flooring system provides a second function for the manufactured home by providing a rigid floor for supporting the manufactured home at the permanent home site. The plural longitudinally extending beams remain with the manufactured home after removal of the removable transport wheel assembly and the removable hitch assembly to provide a rigid support to the permanently mounted manufactured home. The plural longitudinally extending beams remain with the manufactured home to add to the structural integrity and strength of the flooring system. Several examples of the aforementioned dual purpose flooring system are disclosed in the following U.S. Letters Patent of the presented inventor.

U.S. Pat. No. 4,019,299 to Lindsay discloses an improved floor assembly being incorporated into a mobile building. A pair of identical frame assemblies form the floor of the building each including a plurality of middle beams mounted to and atop lower beams and further including a pair of adjacent interior sidewalls attached to the middle beams and extending therebeneath being adjacent the lower beams. The exterior sidewalls are mounted to the frame assemblies. Wheeled carriages are removably mountable to the assemblies facilitating transportation of the assemblies to a building site. A skirt is permanently mounted externally to the sidewalls and extends adjacent the floor assembly. A bracket is connected to the middle beam and the bottom beam of each frame assembly and in addition is connected to a pole which supports the adjacent middle portions of the frame assemblies. The interior sidewalls are slidably received in the bracket. In an alternate embodiment, the floor frame assembly is incorporated into a floor joist.

U.S. Pat. No. 4,863,189 to Lindsay discloses a floor frame assembly, formed principally of wood material, having two load-bearing outer beams and front and rear end members defining a periphery and a plurality of transverse load-supporting trusses connected normal to the outer beam between the end members. In a preferred embodiment, each truss has an upper elongate member, a shorter central elongate member attached parallel thereto by vertical cross-braced elements, and on either side of the central member a braced vertical member spaced therefrom to provide gaps of predetermined height and width. Each truss also has an end portion of the upper elongate member in cantilever form for contact thereat with a load-supporting surface at the permanent location of the floor assembly, so that additional external beams or continuous wall surfaces to support the completed floor frame assembly and any superstructure thereon is rendered unnecessary. The floor frame assembly may be further supported by conventional piers or jackposts at points under two elongate, load-supporting, inner beams closely received and connected to the trusses within the gaps. These inner beams may optionally be made of wood material, wood material supported along the edges at selected portions by metal reinforcement, or entirely formed of I-section beam lengths. In one aspect of the invention, at least one of the load-supporting outer beams has a larger vertical dimension than the other outer beam and two floor frame assemblies thus formed may be united at their respective wider outer beams and provided additional support thereunder to generate a commensurately larger floor frame assembly structure.

U.S. Pat. No. 5,028,072 to Lindsay discloses a unified floor frame assembly having two elongate outer load supporting beams formed of elongate beam sections that are butt-spliced to be cambered in parallel vertical planes to counter forces that may tend to cause sagging of the floor frame assembly during transportation. At inner vertical perimeter surfaces of the elongate beams are provided attachment plates for attachment, first, of a wheel carrier assembly detachably mountable thereto with a plurality of wheels partially recessed within the floor frame assembly and, second, a towing hitch assembly attachable to a forward end of the floor frame assembly for applying a towing force thereat. A moisture, dirt, insect and pest excluding thin covering is provided underneath the floor frame assembly and sections of heating and ventilating ducting, piping, wiring and the like are includable during manufacture of the floor frame assembly. Individual floor frame assemblies may be supported at their permanent location underneath the periphery or, where two such floor frame assemblies are to be coupled to obtain a larger size floor, central elongate beams may be supported by metal posts. Upon delivery of the floor frame assembly to its intended location, the wheel carrier assembly and the towing hitch assembly are both detached and removed therefrom for reuse.

U.S. Pat. No. 5,201,546 to Lindsay discloses a towable unified floor frame assembly deriving lengthwise strength from two elongate I-beams disposed symmetrically about a longitudinal axis. The I-beams are separated by a plurality of angle-sectioned metal cross members welded therebetween. A plurality of trusses, corresponding in number and location to the metal cross members, is disposed to support an outer perimeter and a floor thereabove. Each truss incorporates upwardly inclined bracing elements located outwardly of the I-beams connected to flat metal connecting elements individually unified to the I-beams, preferably by welding. A waterproof and dirt-excluding cover entirely covers the underneath of the floor frame assembly. Heating and ventilating ducts, power and telephone wires, water and waste pipes, thermal insulation and the like, are installed within the floor frame assembly. The entire floor frame assembly, and any superstructure built thereon, may be readily towed to a selected location on a plurality of wheels detachably mounted to brackets provided underneath the I-beams, a towing force being applied by a forwardly disposed detachable towing hitch.

U.S. Pat. No. 5,488,809 to Lindsay discloses a lightweight, strong, safely transportable modular unified floor assembly including a lengthwise wooden girder beam formed with male and female ends to facilitate cooperative integration thereby to another similar floor assembly. In another aspect of the invention, the floor assembly is manufactured with a stairwell opening of selected size and at a selected location. The floor assembly even with a stairwell opening according to this invention is strong enough to be transported comfortably and safely from its point of manufacture to the site at which it is to be located for use.

The first advantage of the dual purpose flooring system is the elimination of the need for a transport carrier for transporting the manufactured home to a permanent site. The second advantage of the dual purpose flooring system is the reduction of the overall height of the manufactured home when the manufactured home is being transported to the permanent home site. The third advantage of the dual purpose flooring system is the additional strength of the flooring system over the conventional flooring system of the prior art.

It is a primary purpose of the present invention to improve upon the aforementioned dual purpose flooring system to provide a more superior manufactured home. It is a specific purpose of the present invention to provide an improved peripheral beam system for a manufactured home.

Another object of this invention is to provide an improved peripheral beam system for a manufactured home incorporating peripheral beams extending along a longitudinal dimension of the floor of the manufactured home for providing a structural rigidity to the floor structure.

Another object of this invention is to provide an improved peripheral beam system for a manufactured home incorporating peripheral beams extending downwardly from the surface of the floor of the manufactured home for supporting the manufactured home relative to a foundation.

Another object of this invention is to provide an improved peripheral beam system for a manufactured home incorporating peripheral beams extending downwardly from the surface of the floor of the manufactured home that eliminates the need for a foundation wall extending upwardly from the ground surface.

Another object of this invention is to provide an improved peripheral beam system for a manufactured home incorporating peripheral beams extending downwardly from the surface of the floor of the manufactured home to eliminate the need for a concrete foundation wall extending upwardly from the ground surface.

Another object of this invention is to provide an improved peripheral beam system for a manufactured home incorporating peripheral beams extending downwardly from the surface of the floor of the manufactured home that eliminates a cost of three to four thousand dollars for building a concrete foundation wall extending upwardly from the ground surface.

Another object of this invention is to provide an improved peripheral beam system for a manufactured home incorporating peripheral beams extending along a longitudinal dimension of the floor of the manufactured home with each of the peripheral beams being in the form of a truss.

Another object of this invention is to provide an improved peripheral beam system for a manufactured home incorporating peripheral beams extending downwardly from the manufactured home to occupy a majority of a vertical dimension between a ground surface and the manufactured home.

Another object of this invention is to provide an improved peripheral beam system for a manufactured home incorporating peripheral beams extending downwardly from the manufactured home below a level of an axle of the transport wheels.

Another object of this invention is to provide an improved peripheral beam system for a manufactured home incorporating peripheral beams for enabling the manufactured home to be mounted onto a foundation at a permanent home site without the use of lifting cranes for lifting the manufactured home off of a transport carrier.

Another object of this invention is to provide an improved peripheral beam system for a manufactured home incorporating peripheral beams for enabling the manufactured home to be mounted onto a foundation at a permanent home site through the use of simple lifting jacks.

Another object of this invention is to provide an improved peripheral beam system for a manufactured home incorporating peripheral beams for enabling the manufactured home to be positioned adjacent longitudinal extending foundations by towing the manufactured home on a removable transport wheel assembly to position the peripheral beams over the longitudinal extending foundations.

Another object of this invention is to provide an improved peripheral beam system for a manufactured home incorporating a multiplicity of transverse beams extending substantially perpendicular to a dimension of the floor of the manufactured home for providing a structural rigidity to the floor structure.

Another object of this invention is to provide an improved peripheral beam system for a manufactured home incorporating a multiplicity of transverse beams extending substantially perpendicular to a dimension of the floor of the manufactured home with each of the multiplicity of transverse beams being in the form of a truss.

Another object of this invention is to provide an improved peripheral beam system for a manufactured home incorporating a multiplicity of transverse beams extending substantially perpendicular to a dimension of the floor of the manufactured home with each of the multiplicity of transverse beams defining an open void for enabling the introduction of pipes, wires and ducts or the like for the manufactured home.

Another object of this invention is to provide an improved peripheral beam system for a manufactured home incorporating a multiplicity of transverse beams extending substantially perpendicular to a dimension of the floor of the manufactured home with each of the multiplicity of transverse beams defining an upwardly facing open void for enabling the introduction of pipes, wires and ducts or the like for the manufactured home.

Another object of this invention is to provide an improved peripheral beam system for a manufactured home incorporating a multiplicity of transverse beams extending substantially perpendicular to a dimension of the floor of the manufactured home with each of the multiplicity of transverse beams defining an upwardly facing open void extending at least one-third of the overall dimension of the transverse beam.

Another object of this invention is to provide an improved peripheral beam system for a manufactured home incorporating a multiplicity of transverse beams extending substantially perpendicular to a dimension of the floor of the manufactured home with each of the multiplicity of transverse beams defining an open void for enabling the introduction of pipes, wires and ducts or the like and including a multiplicity of adjoining transverse beams cooperating with the multiplicity of transverse beams for closing each of the open voids for providing a support for the manufactured home.

Another object of this invention is to provide an improved peripheral beam system for a manufactured home incorporating a multiplicity of transverse beams extending substantially perpendicular to a dimension of the floor of the manufactured home with each of the multiplicity of transverse beams defining an open void for enabling the introduction of pipes, wires and ducts or the like for facilitating the construction of the manufactured home.

Another object of this invention is to provide an improved peripheral beam system for a manufactured home that is adaptable to existing manufacturing processes of manufactured homes.

Another object of this invention is to provide an improved peripheral beam system for a manufactured home that facilitates the assembly of the manufactured home in the manufacturing factory.

Another object of this invention is to provide an improved peripheral beam system for a manufactured home that reduces the overall cost of the manufactured home.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description setting forth the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved peripheral beam system for a manufactured home comprising a multiplicity of transverse beams extending in a substantially parallel relationship. A first and a second peripheral beam are secured to the multiplicity of transverse beams and extending substantially perpendicular thereto for providing a structural rigidity thereto. The first and second peripheral beams extend downwardly from the manufactured home for resting on a foundation to support the manufactured home relative to a foundation.

In a more specific embodiment of the invention, a first and a second longitudinally extending beams supports the multiplicity of transverse beams and extend substantially perpendicular thereto. The first and second longitudinally extending beams may be constructed of a metallic material. In one embodiment of the invention, each of the first and second longitudinally extending beams is in the form of an I-beam having an upper horizontal beam element, a lower horizontal beam element and an interconnecting intermediate vertical beam element.

Each of the first and second longitudinally extending beams have a vertical height extending between an upper horizontal surface and a lower horizontal surface. A removable transport wheel assembly removably is secured adjacent to the lower horizontal surface of the first and second longitudinally extending beams for transporting the manufactured home. A removable hitch assembly may be attached to a towing vehicle to transport the manufactured home.

Preferably, each of the multiplicity of transverse beams is in the form of a truss and defines a first and a second slot for respectively receiving the first and second longitudinally extending beams. A multiplicity of first and second attachment members respectively close the first and second slot for securing each of the multiplicity of transverse beams to the first and second longitudinally extending beams.

In one embodiment of the invention, each of the multiplicity of transverse beams comprises a first and a second truss portion with each of the first and second truss portions being respectively secured to the first and second longitudinally extending beams. An intermediate truss portion interconnects the first and second truss portions for securing the first truss portion to the second truss portion and for forming an open void between the first and second truss portions for enabling the introduction of pipes, wires and ducts or the like for the manufactured home. Preferably, the open void is an upwardly facing open void extending at least one-third of the overall dimension of the transverse beam.

A multiplicity of adjoining transverse beams cooperates with the multiplicity of transverse beams for closing each of the open voids for providing a support for the floor of the manufactured home after introduction of pipes, wires and ducts or the like.

In a specific embodiment of the invention, each of the first and second peripheral beams is in the form of a truss. The first and second peripheral beams are connected to opposed ends of each of the multiplicity of transverse beams. Each of the first and second peripheral beams extend downwardly from the manufactured home to occupy a majority of a vertical dimension between a ground surface and the manufactured home.

Preferably, a removable transport wheel assembly is removably secured to the first and second longitudinally extending beams for transporting the manufactured home. Each of the first and second peripheral beams extend downwardly from the manufactured home in proximity to a level of an axle of the transport wheel assembly for enabling a jack to be positioned below the first and second longitudinally extending beams to lift the manufactured home for removing the removable transport wheel assembly. The first and second peripheral beams extend downwardly a distance sufficient to enable the jack to lower the manufactured home onto the foundation to support the manufactured home relative to a foundation and for enabling the subsequent removal of the jack.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
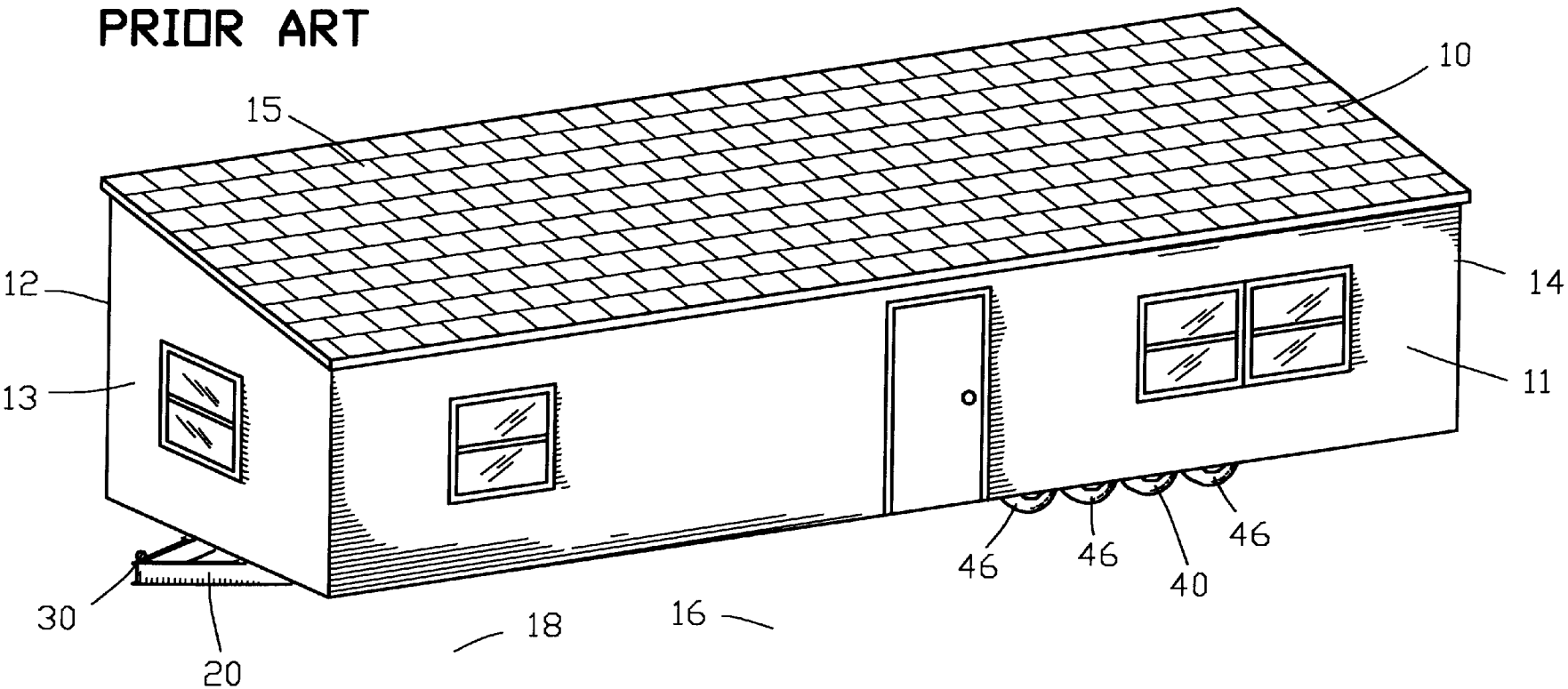
PRIOR ART FIG. 1
FIG. 1 is an isometric view of a manufactured home of the prior art disposed on a carrier transport for transporting the manufactured home to a permanent site.
Figure 2:
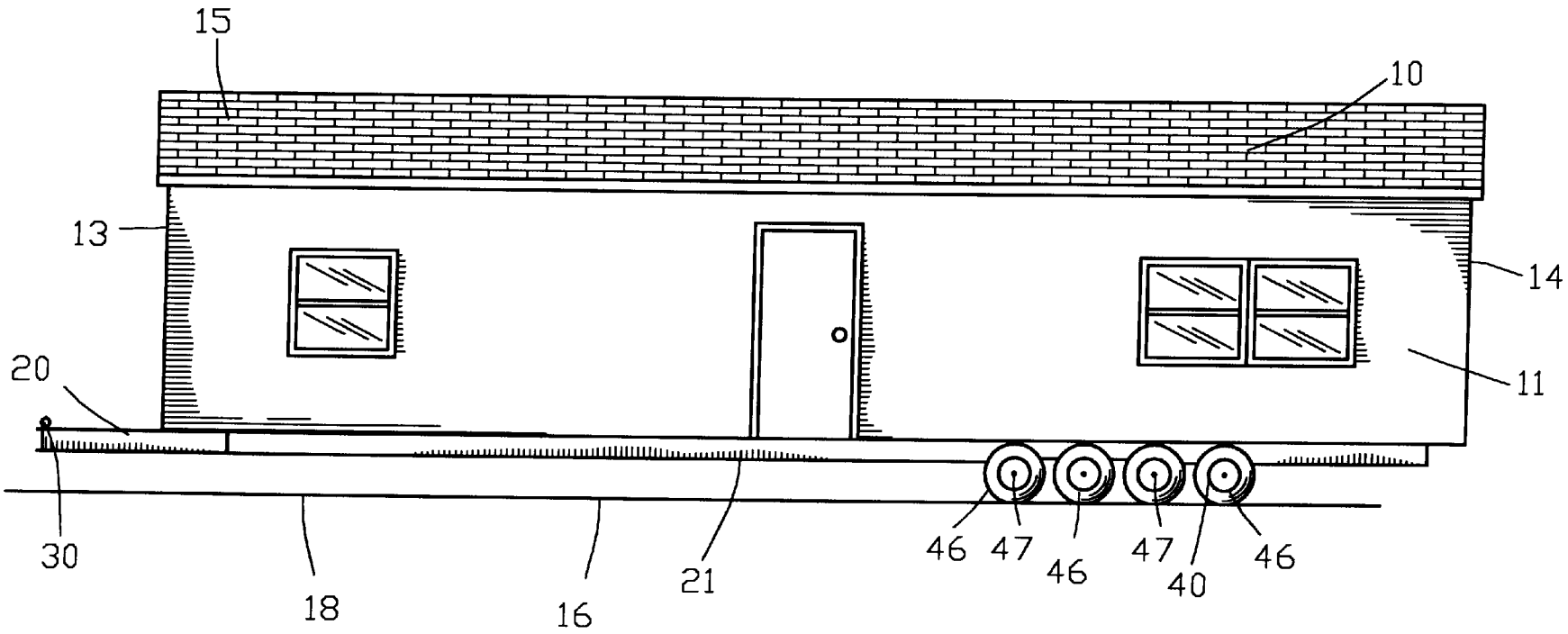
FIG. 2 is a side elevational view of FIG. 1.
Figure 3:
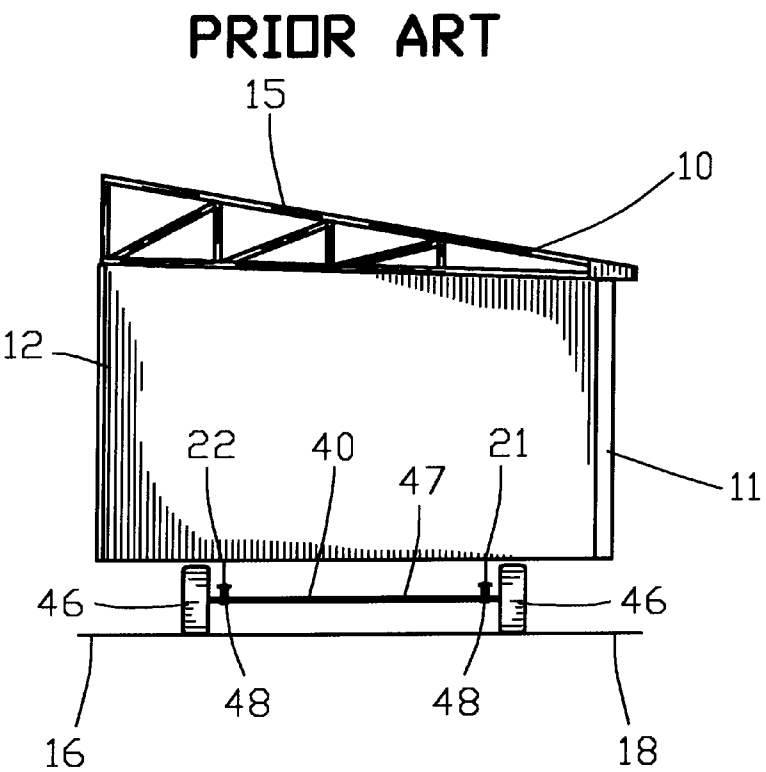
FIG. 3 is an end view of FIG. 2 illustrating the manufactured home disposed on the carrier transport.

FIGS. 1–3 are isometric, side and end views of a manufactured home 10 of the prior art. The manufactured home 10 comprising peripheral walls 11 and 12, end walls 13 and 14 and a roof 15. The manufactured home 10 is designed to be transported to a remote location and to be erected on a ground surface 16 at a building site 18.

After the manufactured home 10 is completed at a manufacturing facility, the manufactured home 10 is placed on a carrier transport 20 and is towed by a towing vehicle such as a truck (not shown) to the building site 18. The manufactured home 10 is shown as one-half of a two-part unit commonly referred to as a double wide manufactured home 10. In the case of a double wide manufactured home 10, the peripheral wall 12 is only a partial wall enabling the manufactured home 10 to be joined with a mirror image of FIG. 3 at the peripheral wall 12 for creating a single double wide unit. The structure and erection of the double wide unit of a manufactured home 10 should be well known to those skilled in the art.

As best shown in FIG. 3, the manufactured home 10 is shown disposed on a carrier transport 20 comprising frame elements 21 and 22 shown as steel I-beams connected to a hitch 30. The carrier transport 20 includes a plurality of wheel assemblies 40 with each of the plurality of wheel assemblies 40 having plural wheels 46 journalled on an axle 47. Each of the plurality of wheel assemblies 40 is secured to the frame elements 21 and 22 by springs 48.

Upon reaching the building site 18, the manufactured home 10 is removed from the carrier transport 20 and is permanently mounted at the building site 18. Thereafter, the carrier transport 20 is returned to the manufacturing facility for transporting another manufactured home to another building site. The carrier transport 20 is returned to the manufacturing factory without a load thereby substantially increasing the overall cost of delivery of the manufactured home 10. It is estimated that the cost of returning the carrier transport 20 to the manufacturing factory is approximately one dollar per mile.

Figure 4:
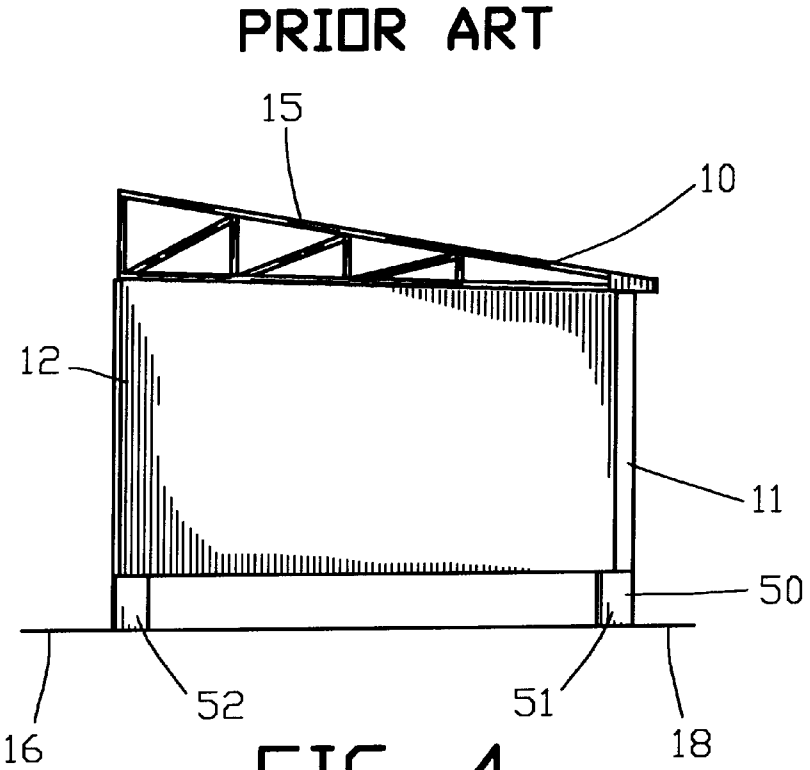
FIG. 4 is an end view of the manufactured home of FIG. 3 which has been removed from the carrier transport of FIG. 3 and placed upon a stem wall foundation.

FIG. 4 is an end view similar to FIG. 3 after the manufactured home 10 has been lifted from the carrier transport 20 and placed upon a foundation 50 comprising foundation pilings 51 and 52 on the ground surface 18. The manufactured home 10 is secured to the foundation pilings 51 and 52 by conventional means which should be well known to those skilled in the art.

The foundation pilings 51 and 52 extend upwardly from the ground surface 16 to space the manufactured home 10 from the ground surface 16. The foundation pilings 51 and 52 are commonly referred to as stem walls. The distance of the stem walls required to space the manufactured home 10 from the ground surface 16 is regulated by local or federal building codes or regulations.

Typically, the manufactured home 10 is lifted or rolled from the carrier transport 20 onto the foundation pilings 51 and 52. The lifting of the manufactured home 10 onto the foundation pilings 51 and 52 requires the use of a lifting crane. Similarly, the rolling of the manufactured home 10 from the carrier transport 20 onto the foundation pilings 51 and 52 requires the use of rolling equipment. The requirement of the use of a crane or rolling equipment significantly increases the cost of the installation of the manufactured home and adds substantially to the overall cost of the manufactured home.

Figure 5:
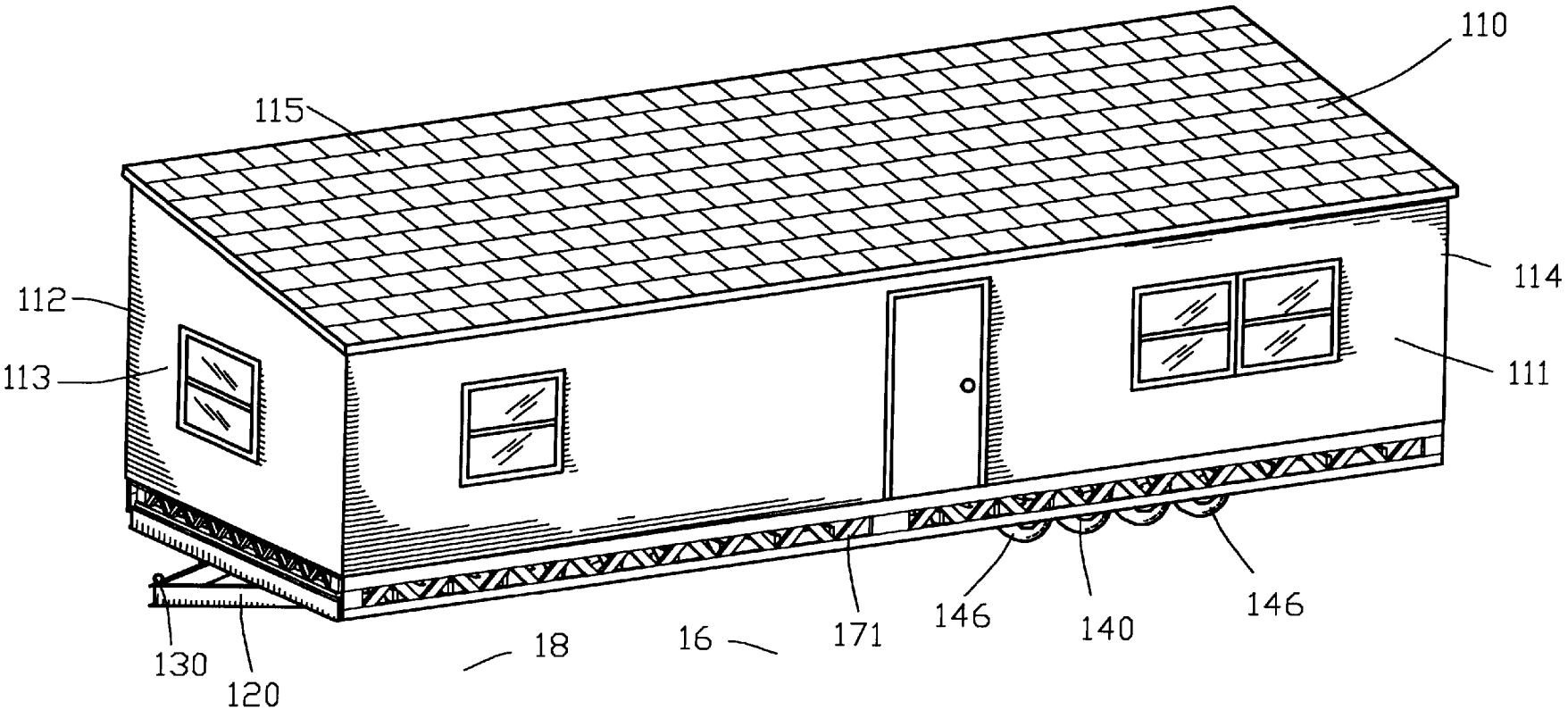
FIG. 5 is an isometric view of a manufactured home incorporating the peripheral beam system of the present invention with a removable transport wheel assembly for transporting the manufactured home to a permanent site.
Figure 6:
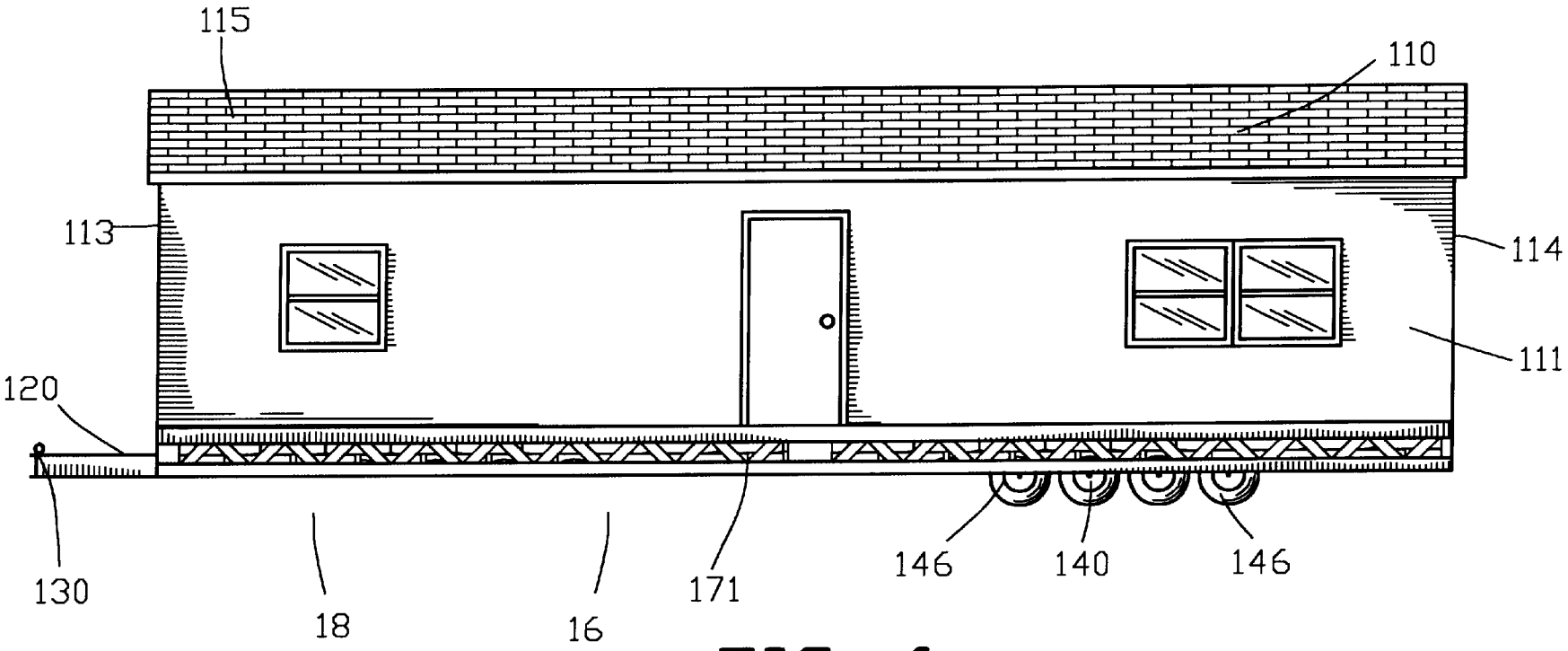
FIG. 6 is a side elevational view of FIG. 5.
Figure 7:
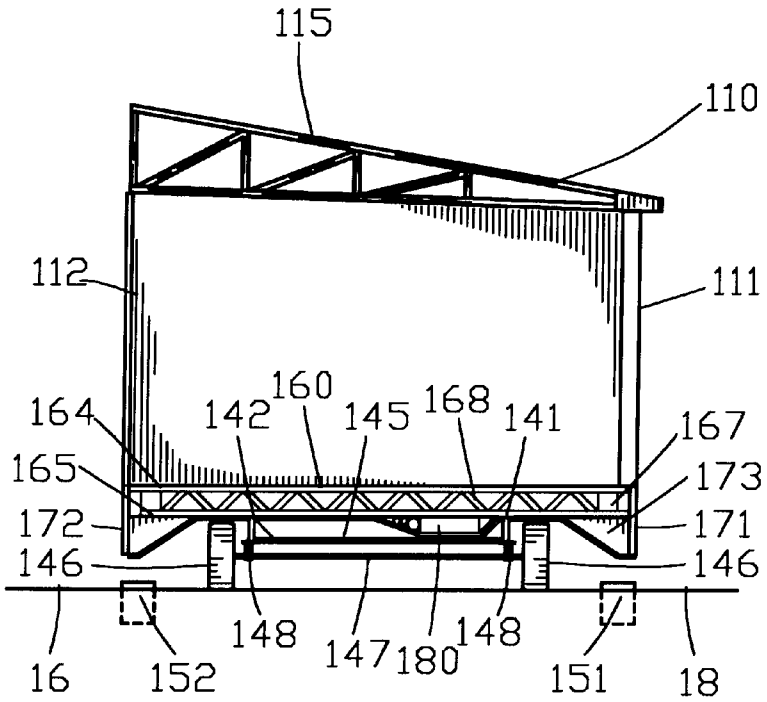
FIG. 7 is an end view of FIG. 6 illustrating the manufactured home disposed on the removable transport wheel assembly.

FIGS. 5–7 are isometric, side and end views of a manufactured home 110 incorporating a peripheral beam system of the present invention. The manufactured home 110 comprising peripheral walls 111 and 112, end walls 113 and 114 and a roof 115. The manufactured home 110 is designed to be transported to a remote location and to be erected on a ground surface 16 at a building site 18.

After the manufactured home 110 is completed at a manufacturing facility, the manufactured home 110 is towed by a towing vehicle such as a truck (not shown) to the building site 18. The manufactured home 110 is shown as one-half of a two-part unit commonly referred to as a double wide manufactured home 110. In the case of a double wide manufactured home 110, the peripheral wall 112 is only a partial wall enabling the manufactured home 110 to be joined with a mirror image of FIG. 7 at the peripheral wall 112 for creating a single double wide unit. The structure and erection of the double wide unit of a manufactured home 110 should be well known to those skilled in the art. Although the manufactured home 110 is shown as one-half of a double wide manufactured home 110, it should be understood that the present invention is equally applicable to a single width manufactured home.

As best shown in FIG. 7, the manufactured home 10 is shown disposed on a removable carrier transport 120 comprising a removable hitch 130 and removable axle and transport wheel assembly 140. The removable axle and transport wheel assembly 140 includes frame elements 141 and 142 shown as steel I-beams being connected to the removable hitch 130. Each of the removable axle and transport wheel assemblies 140 has plural wheels 146 journalled on an axle 147. Each of the removable axle and transport wheel assemblies 140 is secured to the frame elements 141 and 142 by springs 148.

Upon reaching the building site 18, the manufactured home 110 is permanently mounted at the building site 18. In contrast to the prior art carrier transport 20, the removable carrier transport 120 of the present invention enables the manufactured home 110 to be positioned over a foundation comprising footers 151 and 152 located on the ground surface 18. The foundation may be concrete, compressed gravel or gravel depending upon the applicable building code or regulation. Since the footers 151 and 152 are essentially level with or extend slightly above the ground surface 18, the plural wheels 146 of the removable axle and transport wheel assembly 140 can move over the footers 151 and 152. This eliminates the need for the manufactured home 110 to be lifted or rolled onto foundation pilings 51 and 52 as explained with reference to FIGS. 1–4.

The manufactured home 10 comprises a multiplicity of transverse beams 160 arranged in a substantially parallel relationship. A first and a second peripheral beam 171 and 172 are respectively connected to the ends of each of the multiplicity of transverse beams 160. The first and second peripheral beams 171 and 172 extend downwardly from the manufactured home 110 in proximity to the axle 147 of the removable transport wheel assembly 140.

Figure 8:
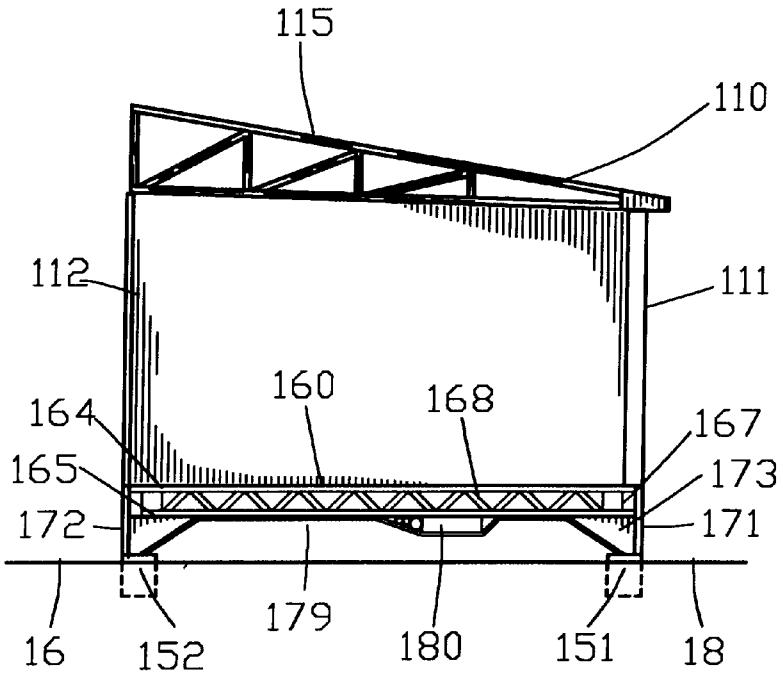
FIG. 8 is an end view of the manufactured home of FIG. 7 disposed upon a footer foundation and after removal of the removable transport wheel assembly.

FIG. 8 is an end view similar to FIG. 7 after the manufactured home 110 has been placed upon the footers 151 and 152 of the ground surface 18. After the manufactured home 110 is positioned over the footers 151 and 152 located on the ground surface 18, the manufactured home 110 is lifted through the use of simple lifting jacks and the removable hitch 130 and the removable axle and transport wheel assemblies 140 are removed from the manufactured home 110. The manufactured home 110 is then lowered for enabling the first and second peripheral beams 171 and 172 to engage with the footers 151 and 152 to support the manufactured home 110 relative to the ground surface 18. The first and second peripheral beams 171 and 172 are connected to the footers 151 and 152 by conventional fasteners to secure the manufactured home 110 to the building site 18.

After the removable hitch 130 and the removable axle and transport wheel assemblies 140 have been removed from the manufactured home 110, the removable hitch 130 and the removable axle and transport wheel assemblies 140 may be returned to the manufacturing facility for reuse in transporting another manufactured home to another building site. The removable hitch 130 and the removable transport wheel assembly 140 may be returned to the manufacturing factory by a conventional freight carrier thus eliminating the need for using the towing vehicle as was the problem in the prior art carrier transports 20.

The footers 151 and 152 are essentially level with or extend slightly above the ground surface 18 for enabling the plural wheels 146 of the removable axle and transport wheel assembly 140 to move over the footers 151 and 152. Preferably, the first and second peripheral beams 171 and 172 extend downwardly from the manufactured home 110 in proximity to the axle 147 of the removable transport wheel assembly 140. After the removable hitch 130 and the removable axle and transport wheel assemblies 140 are removed from the manufactured home 110, the manufactured home 110 is lowered for enabling the first and second peripheral beams 171 and 172 to engage with the footers 151 and 152 to support the manufactured home 110 relative to the ground surface 18. The first and second peripheral beams 171 and 172 extend downwardly from the manufactured home 110 a distance required to space the manufactured home 10 from the ground surface 16 is regulated by local or federal building codes or regulations.

Figure 9:
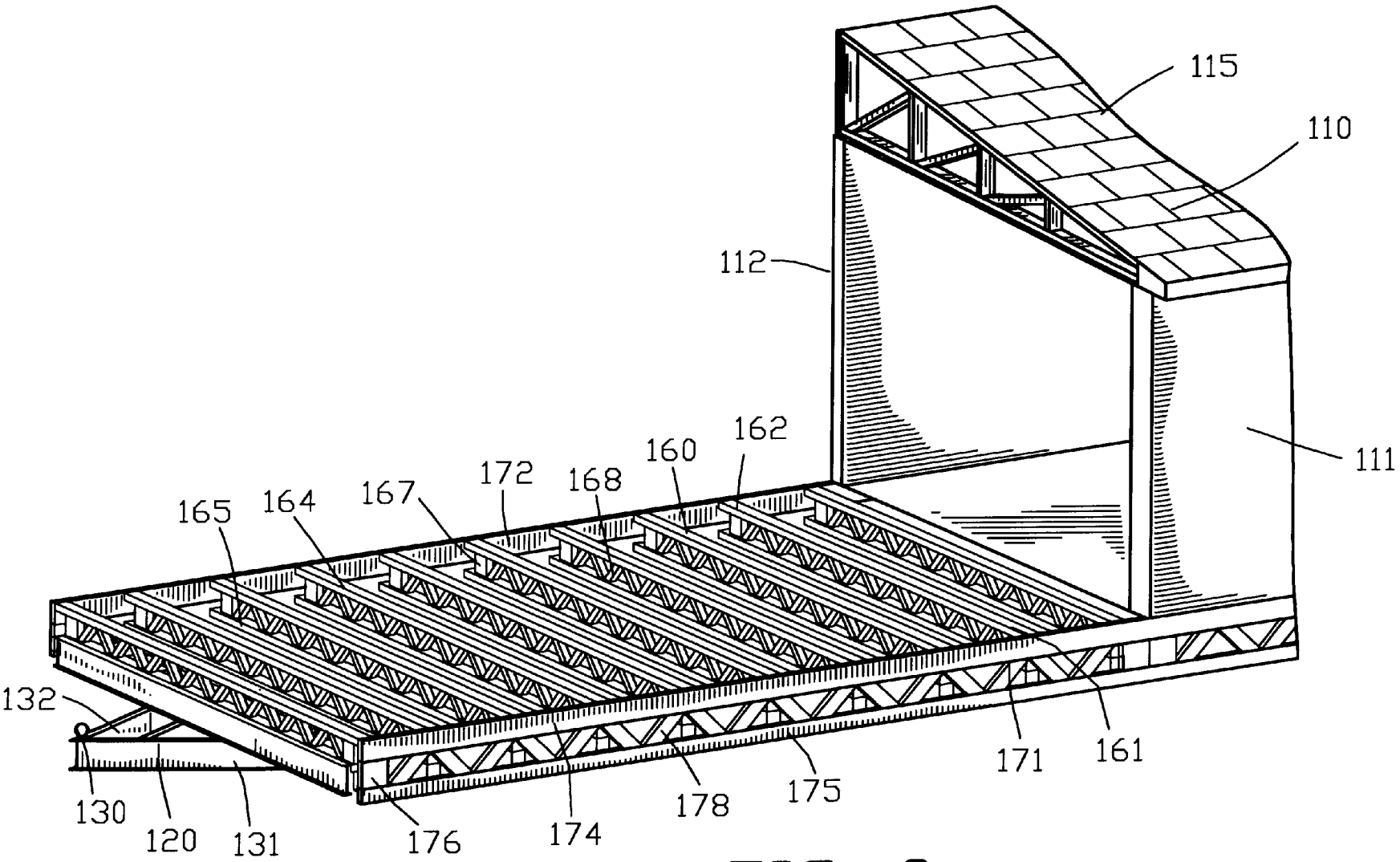
FIG. 9 is an isometric view of a first embodiment of the peripheral beam system of the present invention.
Figure 10:
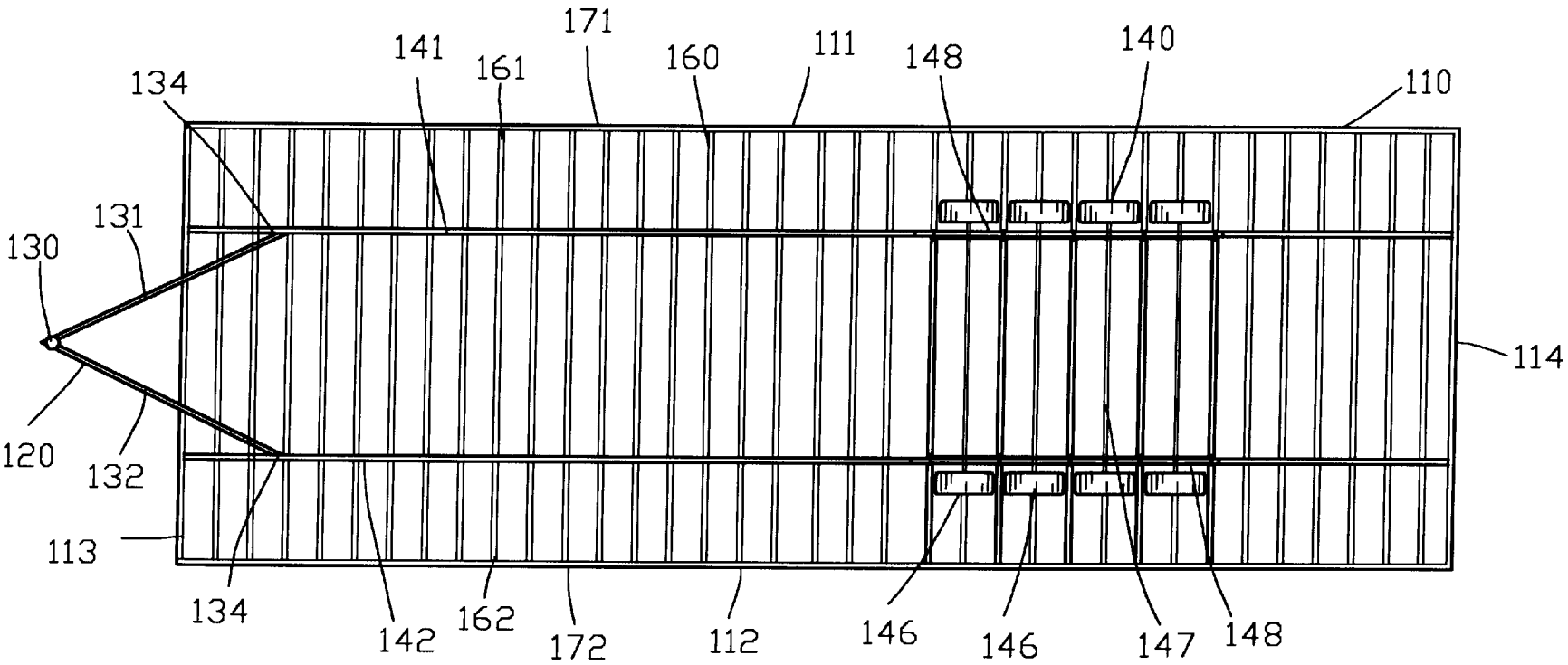
FIG. 10 is a bottom view of FIG. 9.
Figure 11:
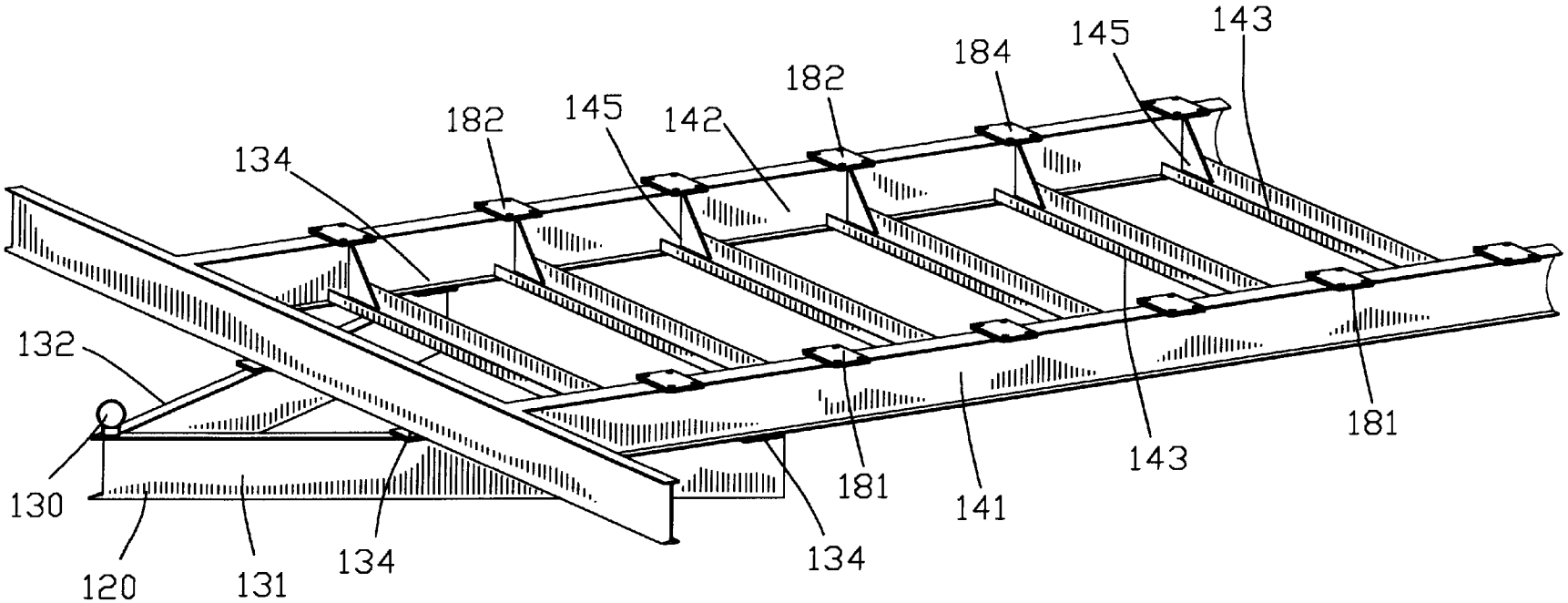
FIG. 11 is an isometric view of a forward portion of the removable transport wheel assembly of FIGS. 9 and 10.
Figure 12:
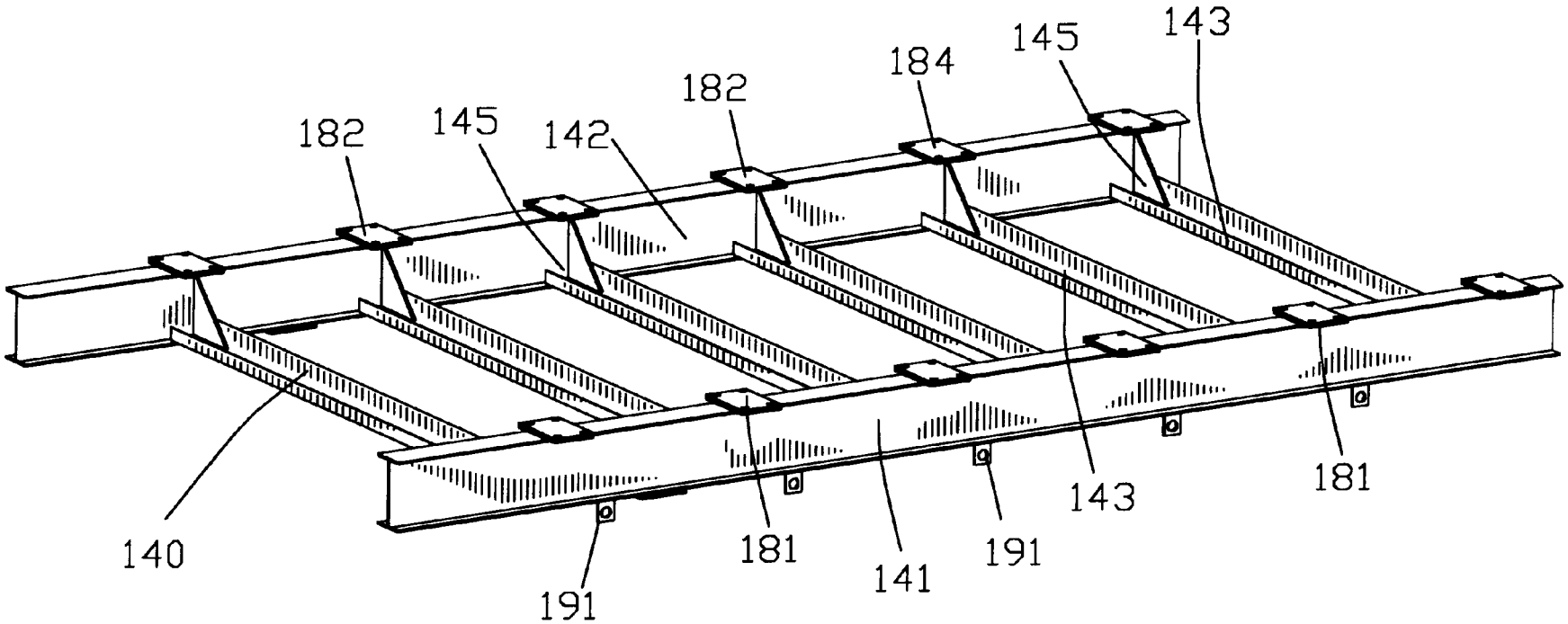
FIG. 12 is an isometric view of a rearward portion of the removable transport wheel assembly of FIGS. 9 and 10.

FIGS. 9 and 10 are isometric and bottom views of a first embodiment of the peripheral beam system of the present invention. The peripheral beam system of the present invention comprises a multiplicity of transverse beams 160 arranged in a substantially parallel relationship. Each of the transverse beams 160 comprises a first and a second end 161 and 162. A first and a second peripheral beam 171 and 172 are respectively connected to the first and second ends 161 and 162 of each of the multiplicity of transverse beams 160. Corner supports 173 interconnect the first and a second peripheral beam 171 and 172 to the first and second ends 161 and 162 of each of the multiplicity of transverse beams 160.

Each of the transverse beams comprises an upper horizontal beam 164 and a lower horizontal beam 165. A plurality of vertical beams 167 vertically space the upper horizontal beam 164 relative to the lower horizontal beam 165. A plurality of diagonal beams 168 interconnect the upper horizontal beam 164 to the lower horizontal beam 165. The beams 164-168 are arranged in substantially the form of a truss.

Each of the peripheral beams 171 and 172 comprises an upper horizontal beam 174, a lower horizontal beam 175. A plurality of vertical beams 176 vertically space the upper horizontal beam 174 relative to the lower horizontal beam 175. A plurality of diagonal beams 178 interconnect the upper horizontal beam 174 to the lower horizontal beam 175. The beams 174-178 are arranged in the form of a truss to provide strength to the present invention.

The transport wheel assembly comprises 140 the first and second longitudinally extending beam 141 and 142 which support a multiplicity of transverse beams 160. The first and second longitudinally extending beams 141 and 142 are shown as metallic I-beams extending substantially the length of the manufactured home 110.

Figure 13:
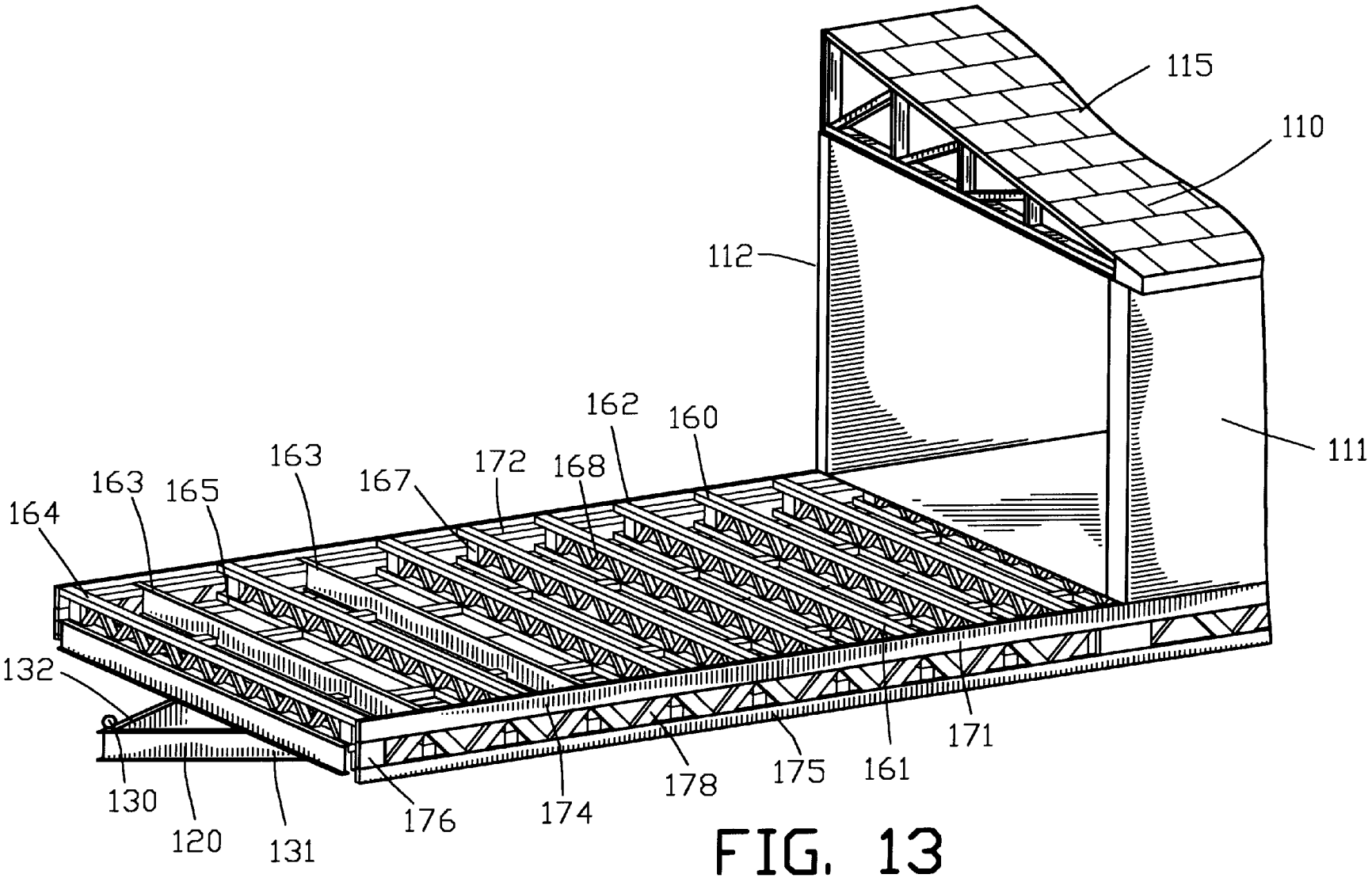
FIG. 13 is an isometric view of a second embodiment of the peripheral beam system of the present invention.
Figure 14:
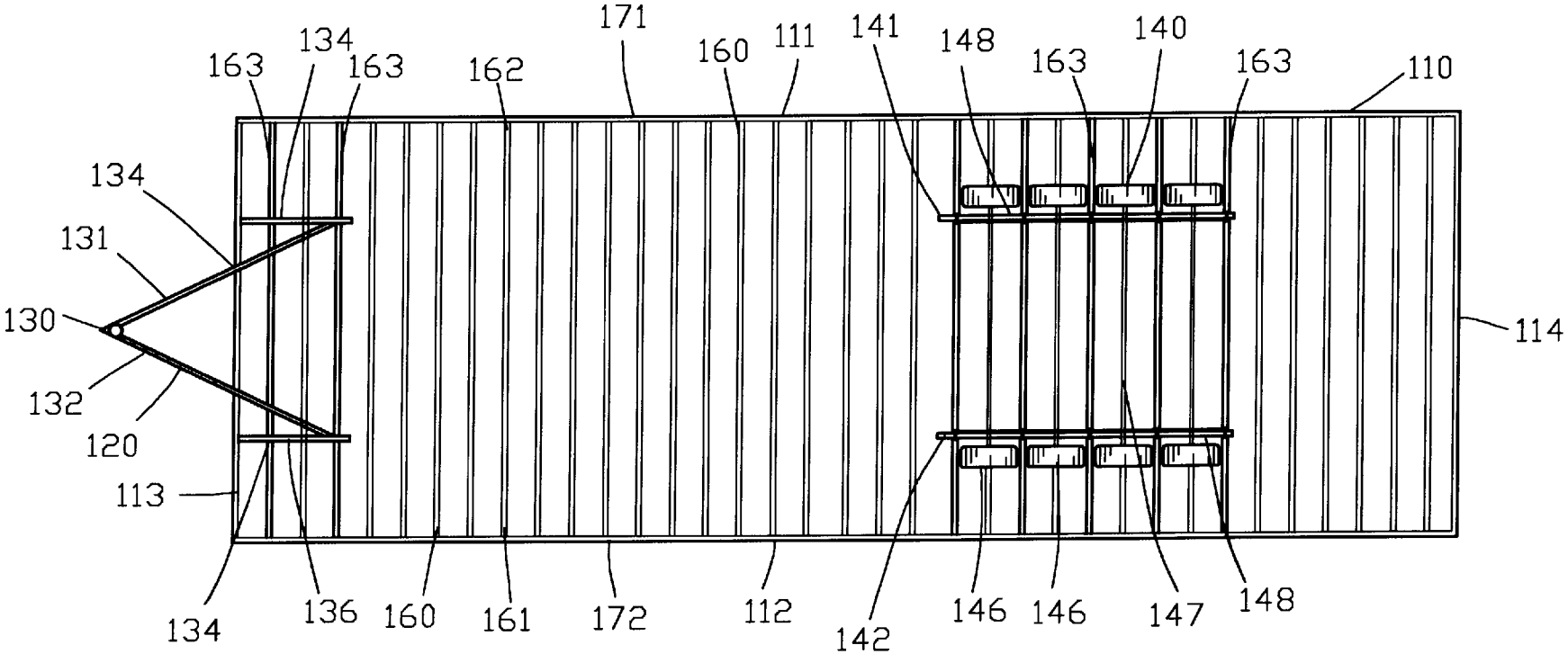
FIG. 14 is a bottom view of FIG. 13.
Figure 15:
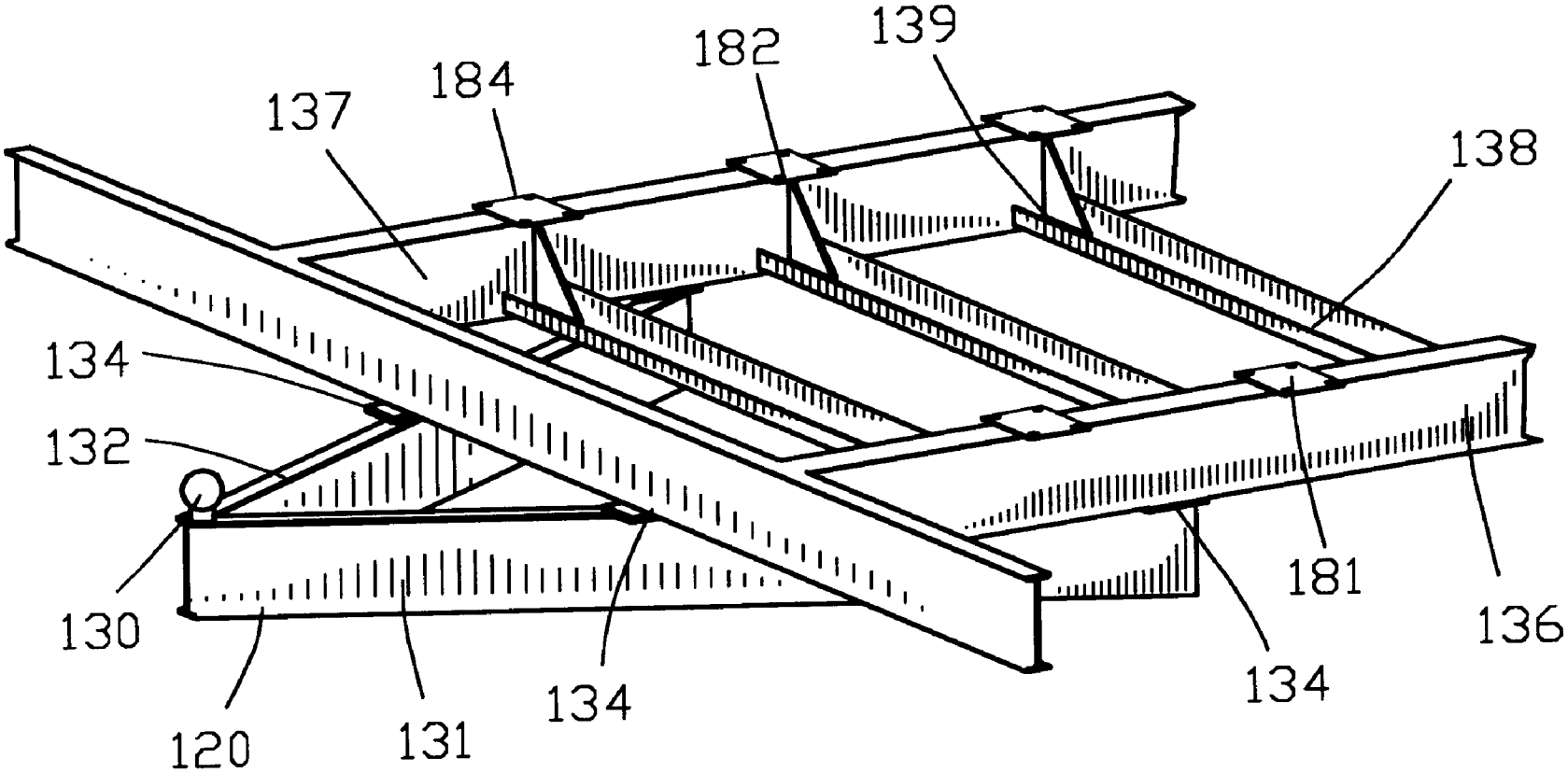
FIG. 15 is an isometric view of a forward portion of the removable transport wheel assembly of FIGS. 13 and 14.

FIG. 15 is an isometric view of a forward portion of the removable transport wheel assembly 140 of FIGS. 13 and 14. A plurality of cross beams 143 are secured between the first and second longitudinally extending beams 141 and 142 by conventional means such as mechanical fasteners or welding for spacing the first and second longitudinally extending beams 141 and 142 into a substantially parallel relationship. Metallic gusset plates 145 may be provided for adding mechanical strength between the plurality of cross beams 143 and the first and second longitudinally extending beams 141 and 142.

The removable transport wheel assembly 140 includes attachment members shown as metallic mounting plates 181 and 182 respectively welded to the first and second longitudinally extending beams 141 and 142. The multiplicity of transverse beams 160 are secured to the first and second longitudinally extending beams 141 and 142 through the metallic mounting plates 181 and 182 and by mechanical fasteners 184.

The removable hitch 130 comprises hitch beams 131 and 132 which are removably secured to the first and second longitudinally extending beam 141 and 142 by mechanical fasteners 134 such as nuts and bolts. The removable hitch 130 and the hitch beams 131 and 132 may be removed from the first and second longitudinally extending beam 141 and 142 upon disconnecting the mechanical fasteners 134.

Figure 16:
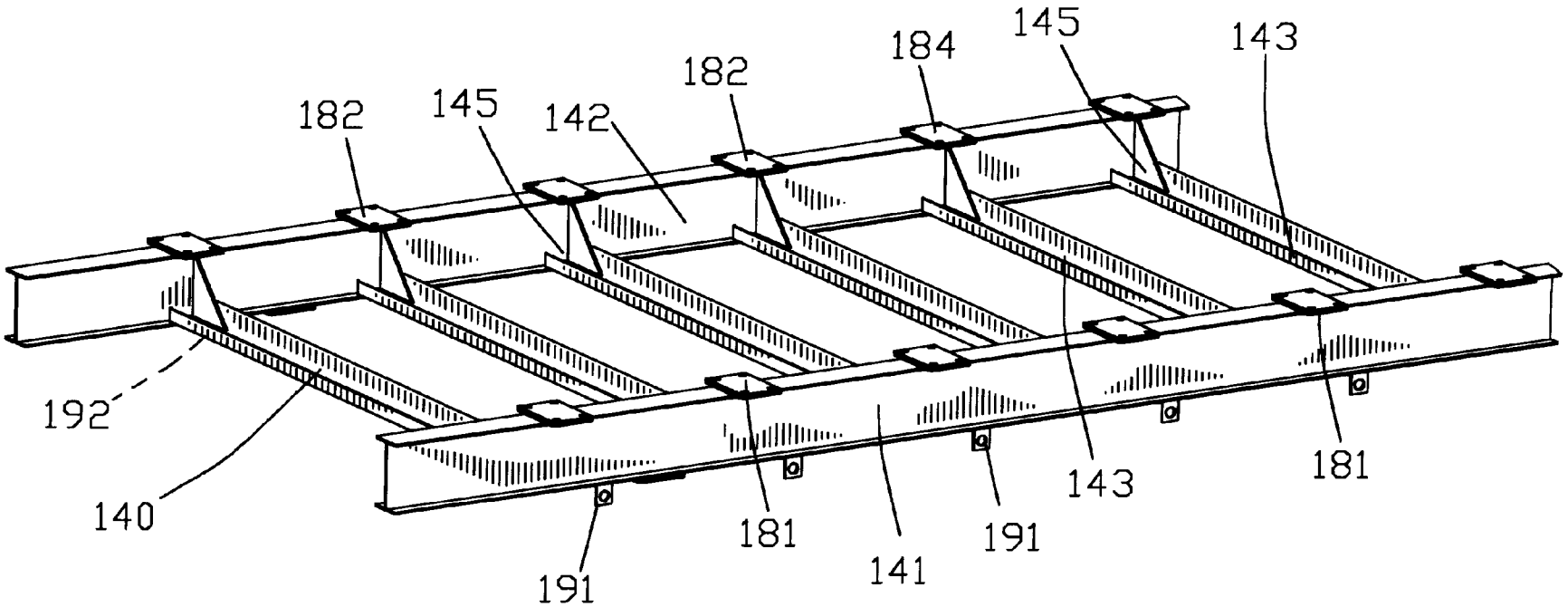
FIG. 16 is an isometric view of a rearward portion of the removable transport wheel assembly of FIGS. 13 and 14.

FIG. 16 is an isometric view of a rearward portion of the removable transport wheel assembly 140. The removable transport wheel assembly 140 comprises the first and second longitudinally extending beams 141 and 142 being provided with spring hangers 191 and 192 for removably mounting the springs 148. The plural wheels 146 are journalled on the axle 147 and are supported by the springs 148. The removable transport wheel assembly 140 may be removed from the first and second longitudinally extending beams 141 and 142 upon disconnecting the springs 148 from the spring hangers 191 and 192.

After the removal of the removable hitch 130 including the hitch beams 131 and 132 and after the removal of the removable transport wheel assembly 140, the first and second longitudinally extending beams 141 and 142 remain with the manufactured home 110. The first and second longitudinally extending beams 141 and 142 extend substantially the length of manufactured home 110 to add substantial strength to the manufactured home 110.

FIGS. 13 and 14 are isometric and bottom views of a second embodiment of the peripheral beam system of the present invention. The peripheral beam system of the present invention comprises a multiplicity of transverse beams 160 arranged in a substantially parallel relationship. Each of the transverse beams 160 comprises a first and a second end 161 and 162. A first and a second peripheral beam 171 and 172 are respectively connected to the first and second ends 161 and 162 of each of the multiplicity of transverse beams 160.

Each of the transverse beams 160 comprises an upper horizontal beam 164 and a lower horizontal beam 165. A plurality of vertical beams 167 vertically space the upper horizontal beam 164 relative to the lower horizontal beam 165. A plurality of diagonal beams 168 interconnect the upper horizontal beam 164 to the lower horizontal beam 165. The beams 164–168 are arranged in substantially the form of a truss.

Each of the peripheral beams 171 and 172 comprises an upper horizontal beam 174, a lower horizontal beam 175. A plurality of vertical beams 176 vertically space the upper horizontal beam 174 relative to the lower horizontal beam 175. A plurality of diagonal beams 178 interconnect the upper horizontal beam 174 to the lower horizontal beam 175. The beams 174–178 are arranged in the form of a truss to provide strength to the present invention.

A plurality of metallic transverse beams 163 are interposed within the multiplicity of transverse beams 160 arranged in the substantially parallel relationship. Preferably, the plurality of metallic transverse beams 163 are shown as metallic I-beams extending between the first and second peripheral beams 171 and 172. The plurality of metallic transverse beams 163 are located to reinforce the area in proximity to the removable hitch 130 and are located to reinforce the area in proximity to the removable transport wheel assembly 140. The plurality of metallic transverse beams 163 transfer the forces applied to the removable hitch 130 and the removable transport wheel assembly 140 to the first and second peripheral beams 171 and 172.

The transport wheel assembly comprises 140 the first and second longitudinally extending beams 141 and 142 which support a multiplicity of transverse beams 160. The first and second longitudinally extending beams 141 and 142 are shown as metallic I-beams extending only partially the length of the manufactured home 110.

FIG. 15 is an isometric view of a forward portion of the removable transport wheel assembly 140 of FIGS. 13 and 14. The removable hitch 130 comprises hitch beams 131 and 132 which are removably secured to a first and second longitudinally extending beam 136 and 137 by mechanical fasteners 134 such as nuts and bolts. The removable hitch 130 and the hitch beams 131 and 132 may be removed from the first and second longitudinally extending beam 136 and 137 upon disconnecting the mechanical fasteners 134.

A plurality of cross beams 138 are secured between the first and second longitudinally extending beams 136 and 137 by conventional means such as mechanical fasteners or welding for spacing the first and second longitudinally extending beams 136 and 137 into a substantially parallel relationship. Metallic gusset plates 139 may be provided for adding mechanical strength between the plurality of cross beams 138 and the first and second longitudinally extending beams 136 and 137.

The removable hitch 130 includes attachment members shown as metallic mounting plates 181 and 182 respectively welded to the first and second longitudinally extending beams 134 and 136. The multiplicity of transverse beams 160 and the plurality of metallic transverse beams 163 are secured to the first and second longitudinally extending beams 134 and 136 through the metallic mounting plates 181 and 182 and by mechanical fasteners 184.

FIG. 16 is an isometric view of a rearward portion of the removable transport wheel assembly 140. The removable transport wheel assembly 140 comprises the first and second longitudinally extending beams 141 and 142 being provided with spring hangers 191 and 192 for removably mounting the springs 148. The plural wheels 146 are journalled on the axle 147 and are supported by the springs 148. The removable transport wheel assembly 140 may be removed from the first and second longitudinally extending beams 141 and 142 upon disconnecting the springs 148 from the spring hangers 191 and 192.

After the removal of the removable hitch 130 including the hitch beams 131 and 132 and the first and second longitudinally extending beams 136 and 137 from the multiplicity of transverse beams 160 of the manufactured home 110, the removable hitch 130 including the hitch beams 131 and 132 may be removed from the first and second longitudinally extending beams 136 and 137 upon disconnecting the mechanical fasteners 134. Thereafter, the first and second longitudinally extending beams 136 and 137 may be discarded and the removable hitch 130 including the hitch beams 131 and 132 may be returned to the manufacturing factory.

In a similar manner, after removal of the removable transport wheel assembly 140 including the first and second longitudinally extending beams 141 and 142 from the multiplicity of transverse beams 160 of the manufactured home 110, the plural wheels 146 and axles 147 and springs 148 may be removed from the first and second longitudinally extending beams 141 and 142 upon disconnecting the mechanical fasteners 134. Thereafter, the first and second longitudinally extending beams 141 and 142 may be discarded and the plural wheels 146 and axles 147 and springs 148 may returned to the manufacturing factory.

Figure 17:
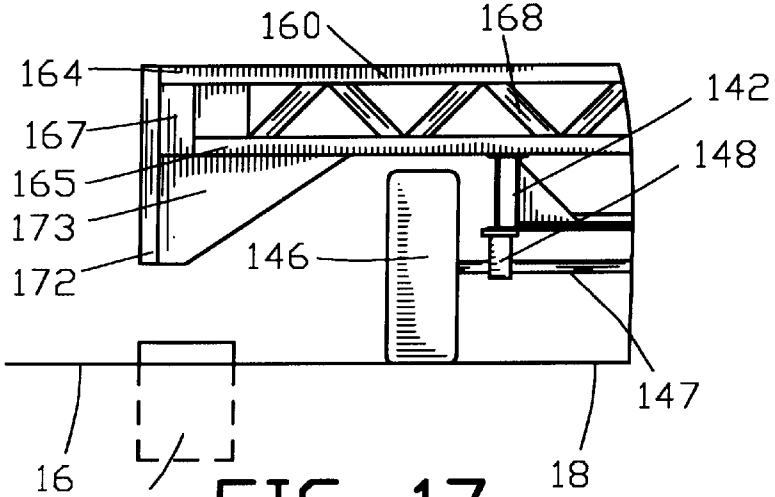
FIG. 17 is an enlarged view of a portion of FIG. 7.
Figure 18:
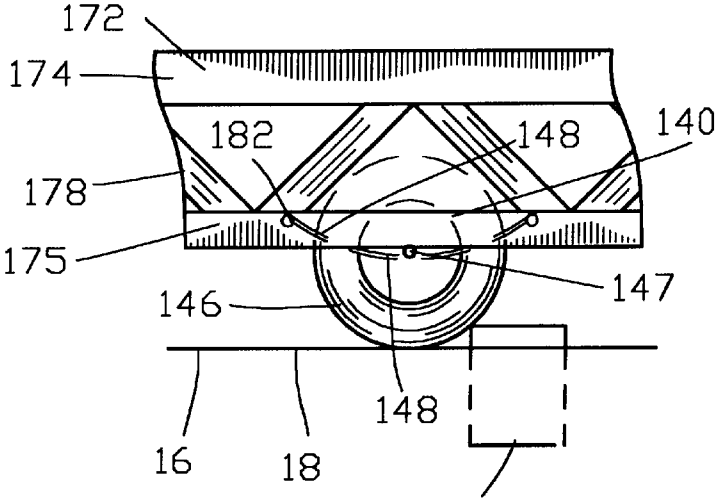
FIG. 18 is a left side view of FIG. 17.

FIG. 17 is an enlarged view of a portion of FIG. 7 with FIG. 18 being is a left side view of FIG. 17. Each of the multiplicity of transverse beams 160 is in the form of an open web truss having a plurality of open voids for enabling air flow through the multiplicity of transverse beams 160. In this embodiment of the invention, the transverse beam 160 is approximately one-half the vertical height of the peripheral beams 172. Preferably, each of the transverse beam 160 is made of wood and being approximately 9.375 inches in height and placed on 16 inch centers.

Each of the first and second peripheral beams 171 and 172 is connected to opposed ends 161 and 162 of each of the multiplicity of transverse beams 160. The multiplicity of corner supports 173 interconnect each of the opposed ends 161 and 162 of the multiplicity of transverse beams 160 to the first and second peripheral beams 171 and 172. Although each of the multiplicity of corner supports 173 is shown as a wood corner support 173 , it should be understood that the corner supports 173 may be made of a metallic or other type of material such as metallic gusset plates.

In this example of the invention, each of the first and second peripheral beams 171 and 172 has a vertical height being substantially greater than the vertical height of the first and second longitudinally extending beams 141 and 142 and being substantially greater than the vertical height of the multiplicity of transverse beams 160. Furthermore, each of the first and second peripheral beams 171 and 172 has a vertical height being commensurate with a combined vertical height of the first and second longitudinally extending beams 141 and 142 and the vertical height of the multiplicity of transverse beams 160.

The first and second peripheral beams 171 and 172 extend downwardly from the manufactured home 110 to a level in proximity to the transport axle 147 of the transport wheel assembly 140 for enabling a jack to lift the manufactured home 110 for removing the removable transport wheel assembly 140.

Figure 19:
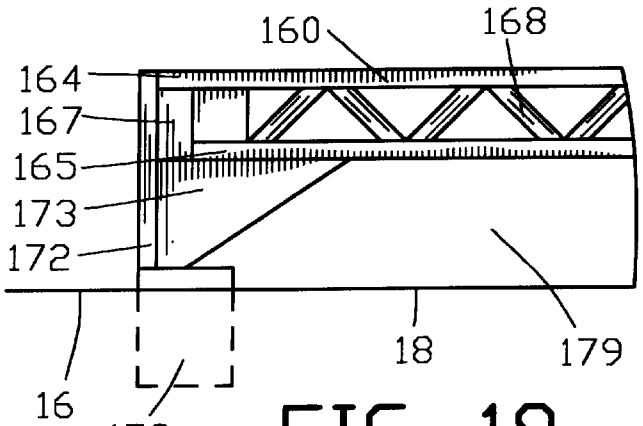
FIG. 19 is an enlarged view of a portion of FIG. 8.
Figure 20:
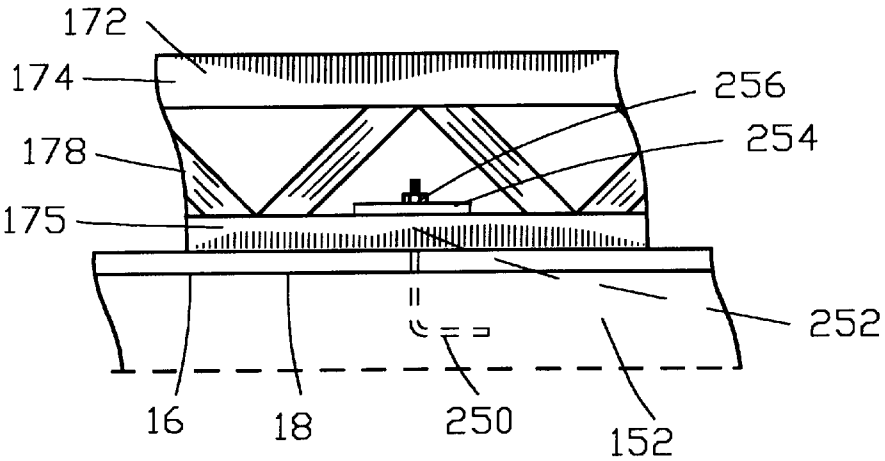
FIG. 20 is a left side view of FIG. 18.

FIG. 19 is an enlarged view of a portion of FIG. 8 with FIG. 20 being a left side view of FIG. 18. The second peripheral beam 172 extends downwardly from the manufactured home 110 for resting on a foundation 152 to support the manufactured home and to space the manufactured home 110 relative to the foundation 110.

Each of the first and second peripheral beams 171 and 172 extend downwardly from the manufactured home 110 to occupy a majority of a vertical dimension between a ground surface 16 and the manufactured home 110 for creating a crawl space therebetween for enabling an operator to enter the crawl space between the ground surface 16 and the manufactured home 110. Furthermore, the plurality of open voids in the first and second peripheral beams 171 and 172 enable an air flow through the first and second peripheral beams 171 and 172.

Preferably, the each of the first and second peripheral beams 171 and 172 extend downwardly from the manufactured home 110 a distance from 14 to 18 inches to properly space the manufactured home 110 off of the ground surface 16 as shown in FIGS. 18 and 19. The spacing of the manufactured home 110 off of the ground surface 16 is regulated by state and federal building codes and regulations. Accordingly, the distance the first and second peripheral beams 171 and 172 extend downwardly from the manufactured home 110 may be adjusted to comply with these state and federal building codes and regulations.

Preferably, the first and second peripheral beams 171 and 172 is anchored to the foundation footings 151 and 152 in accordance with state and federal building codes and regulations. Furthermore, the first and second peripheral beams 171 and 172 may be protected from insect damage by using suitable metallic shields or using chemically treated wood.

FIG. 20 illustrate an example of an anchor system for anchoring the manufactured home 110. In this example of the invention, a threaded anchor rod 250 is secured within the foundation footing 152 to extend upwardly therefrom. The threaded anchor rod 250 extend through an aperture 252 within the lower horizontal beam 175. An anchor plate 254 is placed upon the a top surface of the lower horizontal beam 175 and is secured thereto by a nut 256. It should be understood by those skilled in the art that numerous methods may be used for anchoring the manufactured home 110.

Figure 21:
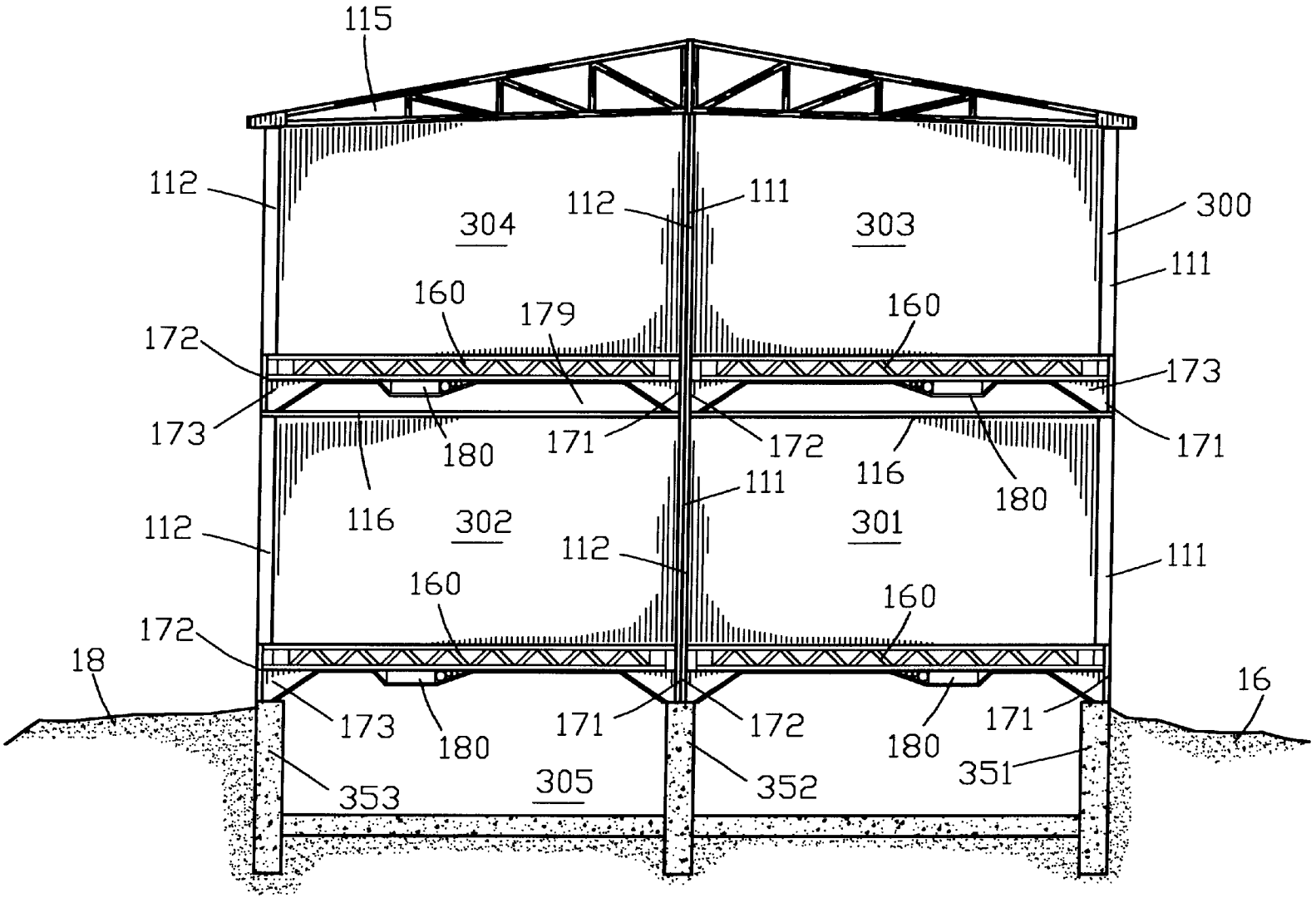
FIG. 21 is an end view of multiple components of a manufactured home incorporating the peripheral beam system of the present invention and disposed upon a foundation and after removal of the removable transport wheel assembly.

FIG. 21 is an end view of a multiple story manufactured home 300 built in accordance with the present invention. The multiple story manufactured home 300 comprises four units 301–304 with units 301 and 302 comprising the first floor and with units 303 and 304 comprising the second floor. First floor unit 301 is a mirror of first floor unit 302 whereas second floor unit 303 is a mirror of the second floor unit 304.

The first floor units 301 and 302 include roof beams 116 extending between the first and second sidewalls 111 and 112 for establishing and maintaining the position of the upper portions of the sidewalls 111 and 112 of each of the first floor units 301 and 302. Each of the first floor units 301 and 302 include a multiplicity of transverse beams 160 and a first and a second peripheral beam 171 and 172 as heretofore described.

In this embodiment, the foundation is shown as foundation walls 351–353 disposed about a basement. The center foundation wall 352 may be a foundation wall as shown or may be a beam extending across the span of the basement 305 as should be well known to those skilled in the art.

The first floor units 301 and 302 are positioned on the foundation walls 351–353 and are shown with the first floor units 301 and 302 being joined by conventional means as should be well known to those skilled in the art.

Each of the second floor units 303 and 304 comprise of the multiplicity of transverse beams 160 and peripheral beams 171 and 172. The second floor units 303 and 304 are positioned such that the peripheral beams 171 and 172 of the upper unit 303 are positioned directly upon the sidewalls 111 and 112 of the first floor unit 301. In a similar manner, the peripheral beams 171 and 172 of the second floor unit 304 are positioned directly above the sidewalls 11 and 12 of the first floor unit 302. Accordingly, the second floor units 303 and 304 are supported by the foundation 351–353 through the compression of sidewalls 111 and 112 of the first floor units 301 and 302.

Voids 179 are defined between the roof beams 116 of the first floor units 301 and 302 and the multiplicity of transverse beams 160 of the second floor units 303 and 304 for accommodating and receiving pipes, electrical conduits, air ducts or the like 180.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. In a manufactured home having a multiplicity of transverse beams extending in a substantially parallel relationship with a first and a second peripheral beam connected to opposed ends of each of said multiplicity of transverse beams, the improvement comprising:

said fist and second peripheral beams extending downwardly from said multiplicity of transverse beams for supporting the manufactured home relative to the ground;

each of the first and second peripheral beams comprising an upper horizontal beam and a lower horizontal beam with a plurality of vertical beams vertically spacing said upper horizontal beam relative to said lower horizontal beam and with a plurality of diagonal beams interconnecting said upper horizontal beams to said lower horizontal beam to provide a first and second peripheral truss beam; and said first and second peripheral beams spacing said multiplicity of transverse beams of said manufactured home from the ground surface with each of said first and second peripheral beams occupying a majority of a vertical dimension between said multiplicity of transverse beams of the manufactured home and the ground when said first and second peripheral beams are supporting the manufactured home relative to the ground.

2. In a manufactured home having a first and a second longitudinally extending beam disposed in a substantially parallel orientation supporting a multiplicity of transverse beams extending substantially perpendicularly to said first and second longitudinally extending beams, a first and a second peripheral beam connected to opposed ends of each of said multiplicity of transverse beams, and a transport wheel assembly comprising a transport axle journaling plural transport wheels with said transport wheel assembly being removably secured to said first and second longitudinally extending beams for transporting the manufactured home;

the improvement comprising:

said first and second peripheral beams extending downwardly from said multiplicity of transverse beams for supporting the manufactured home relative to the ground;

said first and second peripheral beams spacing said multiplicity of transverse beams of said manufactured home from the ground with each of said first and second peripheral beams occupying a majority of a vertical dimension between said multiplicity of transverse beams of the manufactured home and the ground when said first and second peripheral beams are supporting the manufactured home relative to the ground;

said first and second longitudinally extending beams having a vertical height extending between an upper horizontal surface and a lower horizontal surface;

said multiplicity of transverse beams having a vertical height extending between an upper horizontal surface and a lower horizontal surface; and each of said first and second peripheral beams having a vertical height being substantially greater than said vertical height of said first and second longitudinally extending beams and being substantially greater than said vertical height of said multiplicity of transverse beams.

3. A manufactured home as set forth in claim 2, wherein each of said first and second peripheral beams has a vertical height being commensurate with a combined vertical height of said first and second longitudinally extending beams and said vertical height of said multiplicity of transverse beams.

4. A manufactured home as set forth in claim 2, wherein said first and second longitudinally extending beams are constructed of a metallic material.

5. In a manufactured home having a first and a second longitudinally extending beam disposed in a substantially parallel orientation supporting a multiplicity of transverse beams extending substantially perpendicularly to said first and second longitudinally extending beams, a first and a second peripheral beam connected to opposed ends of each of said multiplicity of transverse beams, and a transport wheel assembly comprising a transport axle journaling plural transport wheels with said transport wheel assembly being removably secured to said first and second longitudinally extending beams for transporting the manufactured home;

the improvement comprising:

said first and second peripheral beams extending downwardly from said multiplicity of transverse beams to a level in proximity to said transport axle of said transport wheel assembly;

each of the first and second peripheral beams comprising an upper horizontal beam and a lower horizontal beam with a plurality of vertical beams vertically spacing said upper horizontal beam relative to said lower horizontal beam and with a plurality of diagonal beams interconnecting said upper horizontal beams to said lower horizontal beam to provide a first and second peripheral truss beam;

said transport wheel assembly enabling the manufactured home to be rolled into positioned over the ground whereat the transport wheel assembly may be removed from the manufactured home for enabling the manufactured home to be lowered to be supported by said first and second peripheral beams;

said first and second peripheral beams spacing said multiplicity of transverse beams of the manufactured home from the ground to create a crawl space between the ground and the manufactured home; and each of said first and second peripheral beams having a plurality of open voids for enabling an operator to enter said crawl space defined between the ground and the manufactured home through said open voids.

6. In a manufactured home having a first and a second longitudinally extending beam disposed in a substantially parallel orientation supporting a multiplicity of transverse beams extending substantially perpendicularly to said first and second longitudinally extending beams, a first and a second peripheral beam connected to opposed ends of each of said multiplicity of transverse beams, and a transport wheel assembly comprising a transport axle journaling plural transport wheels with said transport wheel assembly being removably secured to said first and second longitudinally extending beams for transporting the manufactured home;

the improvement comprising:

said first and second peripheral beams extending downwardly from said multiplicity of transverse beams to a level in proximity to said transport axle of said transport wheel assembly;

each of the first and second peripheral beams comprising an upper horizontal beam and a lower horizontal beam with a plurality of vertical beams vertically spacing said upper horizontal beam relative to said lower horizontal beam and with a plurality of diagonal beams interconnecting said upper horizontal beams to said lower horizontal beam to provide a first and second peripheral truss beam;

said transport wheel assembly enabling the manufactured home to be rolled into positioned over the ground whereat the transport wheel assembly may be removed from the manufactured home for enabling the manufactured home to be lowered to be supported by said first and second peripheral beams;

said first and second peripheral beams spacing said multiplicity of transverse beams of the manufactured home from the ground with each of said first and second peripheral beams occupying a majority of a vertical dimension between said multiplicity of transverse beams of the manufactured home and the ground when said first and second peripheral beams are supporting the manufactured home relative to the ground thereby creating a crawl space between the ground and the manufactured home; and each of said first and second peripheral beams having a plurality of open voids for enabling an operator to enter said crawl space defined between the ground and the manufactured home through said open voids.

7. In a manufactured home having a multiplicity of transverse beams extending in a substantially parallel relationship, with a first and a second peripheral beam connected to opposed ends of each of said multiplicity of transverse beams, and with a transport wheel assembly comprising a transport axle journaling plural transport wheels with said transport wheel assembly being removably secured under said multiplicity of transverse beams for transporting the manufactured home;

the improvement comprising:

said first and second peripheral beams extending downwardly from said multiplicity of transverse beams to a level in proximity to said transport axle of said transport wheel assembly;

said transport wheel assembly enabling the manufactured home to be rolled over a foundation extending upwardly from the ground and positioned on the ground whereat the transport wheel assembly may be removed from the manufactured home for enabling the manufactured home to be lowered to be supported by said first and second peripheral beams on the foundation; and said first and second peripheral beams spacing said multiplicity of transverse beams of the manufactured home from the ground with each of said first and second peripheral beams occupying a majority of a vertical dimension between said multiplicity of transverse beams of the manufactured home and the ground when said first and second peripheral beams are supporting the manufactured home relative to the ground.

8. In a manufactured home having a first and a second longitudinally extending beam disposed in a substantially parallel orientation supporting a multiplicity of transverse beams extending substantially perpendicularly to said first and second longitudinally extending beams, a first and a second peripheral beam connected to opposed ends of each of said multiplicity of transverse beams, and a transport wheel assembly comprising a transport axle journaling plural transport wheels with said transport wheel assembly being removably secured to said first and second longitudinally extending beams for transporting the manufactured home;

the improvement comprising:

said first and second peripheral beams extending downwardly from said multiplicity of transverse beams to a level in proximity to said transport axle of said transport wheel assembly;

each of the first and second peripheral beams comprising an upper horizontal beam and a lower horizontal beam with a plurality of vertical beams vertically spacing said upper horizontal beam relative to said lower horizontal beam and with a plurality of diagonal beams interconnecting said upper horizontal beams to said lower horizontal beam to provide a first and second peripheral truss beam;

said transport wheel assembly enabling the manufactured home to be rolled over a foundation extending upwardly from the ground and positioned on the ground whereat the transport wheel assembly may be removed from the manufactured home for enabling the manufactured home to be lowered to be supported by said first and second peripheral beams on the foundation;

said first and second peripheral beams spacing said multiplicity of transverse beams of the manufactured home from the ground with each of said first and second peripheral beams occupying a majority of a vertical dimension between said multiplicity of transverse beams of the manufactured home and the ground when said first and second peripheral beams are supporting the manufactured home relative to the ground thereby creating a crawl space between the ground and the manufactured home; and each of said first and second peripheral beams having a plurality of open voids for enabling an operator to enter said crawl space defined between the ground and the manufactured home through said open voids.

* * * * *